US010160629B2

(12) United States Patent
Wenjing et al.

(10) Patent No.: US 10,160,629 B2
(45) Date of Patent: Dec. 25, 2018

(54) ELECTRIC PERSONNEL LIFT DEVICE

(71) Applicants: Wu Wenjing, Hangzhou (CN); Weng Lijian, Hangzhou (CN); Wang Zheng, Hangzhou (CN); William John Pedriana, Elm Grove, WI (US)

(72) Inventors: Wu Wenjing, Hangzhou (CN); Weng Lijian, Hangzhou (CN); Wang Zheng, Hangzhou (CN); William John Pedriana, Elm Grove, WI (US)

(73) Assignee: BIG LIFT, LLC, Lombard, IL (US)

( * ) Notice: Subject to any disclaimer, the term of this patent is extended or adjusted under 35 U.S.C. 154(b) by 0 days.

(21) Appl. No.: 15/468,401

(22) Filed: Mar. 24, 2017

(65) Prior Publication Data

US 2018/0273365 A1 Sep. 27, 2018

(51) Int. Cl.
*B66F 11/04* (2006.01)
*B66F 17/00* (2006.01)

(52) U.S. Cl.
CPC ..... *B66F 11/04* (2013.01); *B66F 17/006* (2013.01)

(58) Field of Classification Search
CPC ..... B66F 11/04; B66F 17/006
See application file for complete search history.

(56) References Cited

U.S. PATENT DOCUMENTS 1,759,424 A * 5/1930 Strauss ..... E06C 1/26 16/44
2,762,659 A * 9/1956 Harlan ..... E04G 1/22 182/141
3,180,450 A 4/1965 Crager et al.
3,344,885 A * 10/1967 Rasmussen ..... B66B 9/16 182/103
3,417,841 A * 12/1968 Lebre ..... B66B 5/18 182/136
3,666,046 A * 5/1972 Meineck, Jr. ..... E04G 1/18 182/145
5,121,816 A 6/1992 Curtin
5,203,425 A 4/1993 Wehmeyer
5,273,132 A 12/1993 Sasaki et al.
5,322,408 A 6/1994 Wooden
5,425,433 A * 6/1995 Huber ..... B66F 11/04 182/145

(Continued)

FOREIGN PATENT DOCUMENTS

DE 102010036409 A1 1/2012
FR 2717456 A1 * 9/1995 ..... B66F 11/04

(Continued)

*Primary Examiner* — Alvin C Chin-Shue
(74) *Attorney, Agent, or Firm* — Cook Alex Ltd.

(57) ABSTRACT

An electric personnel lift device that includes a base assembly having a frame and two columns that are laterally spaced apart and mounted to the frame is disclosed. Each of the two columns has a lift cylinder device mounted in the respective column and extending upward. The electric personnel lift device further includes a height adjustable platform assembly having an operator platform and two laterally spaced apart handrail assemblies connected to the operator platform. The height adjustable platform assembly is connected to an upper end of a movable portion of each lift cylinder device and is slidably coupled to the columns, wherein the height adjustable platform assembly is movable between at least a lowered position and a raised position.

19 Claims, 9 Drawing Sheets

(56) References Cited

U.S. PATENT DOCUMENTS

| | | | | |
|---|---|---|---|---|
| 5,461,736 | A | 10/1995 | Carpenter et al. | |
| 5,755,306 | A | 5/1998 | Kraemer et al. | |
| 5,803,204 | A | 9/1998 | White et al. | |
| 5,941,341 | A * | 8/1999 | Gillis | E06C 1/397 182/15 |
| 6,174,124 | B1 | 1/2001 | Harverfield et al. | |
| 6,241,047 | B1 * | 6/2001 | Gilliland | B66F 9/06 180/19.3 |
| 7,140,467 | B2 * | 11/2006 | Cook | B60R 3/005 182/143 |
| 7,753,169 | B1 * | 7/2010 | Kurtz | E06C 1/39 182/129 |
| 7,828,115 | B2 * | 11/2010 | Sayles | E06C 1/397 182/15 |
| 8,863,899 | B2 | 10/2014 | Solhjem et al. | |
| 8,985,275 | B2 | 3/2015 | Solhjem et al. | |
| 9,108,831 | B2 | 8/2015 | Beji | |
| 9,212,038 | B1 | 12/2015 | Presti | |
| 2007/0086880 | A1 * | 4/2007 | Jordan | A61G 7/1011 414/630 |
| 2013/0168185 | A1 | 7/2013 | Huang et al. | |

FOREIGN PATENT DOCUMENTS

| | | | | | |
|---|---|---|---|---|---|
| FR | 2984292 | A1 | | 6/2013 | |
| GB | 135834 | A | * | 7/1920 | F01C 19/04 |
| GB | 885824 | A | * | 12/1961 | B66F 11/04 |
| GB | 2493487 | A | | 2/2013 | |
| WO | WO 99/41186 | | | 8/1999 | |

* cited by examiner

ELECTRIC PERSONNEL LIFT DEVICE

FIELD OF THE DISCLOSURE

The present disclosure relates generally to personnel lifts or order pickers, and more particularly, to compact electric low level personnel lift devices having a height adjustable platform that is operable to lift and lower an operator.

BACKGROUND

There are many instances in commercial settings, such as retail stores, warehousing or industrial environments, where objects are placed above the normal reach of an individual standing on a floor surface. Efficient storage tends to utilize shelving or cabinetry that essentially stacks objects vertically. As a result, an individual may need an increase in reach to grasp an elevated object.

There are numerous manual devices that may be used to climb to a higher position for grasping elevated objects, such as a ladder or step stool. Such devices typically are somewhat cumbersome to use because they must be lifted and carried to a location for use, or they may be in the form of a rolling staircase, which consumes a very large amount of floor space during use and when stowed. Devices that require climbing also can present safety concerns. Climbing requires increased physical effort, presents a potential tripping hazard while ascending and descending stairs, and requires the use of at least one hand to steady oneself, reducing the ability to use both hands to grasp and hold an object being retrieved.

Fully powered lift devices have been developed that permit a user to operate a lift platform to be moved to a higher position. Such devices often are referred to as stock pickers, because a user is able to ascend to a level where the user can reach a stocked item, and then descend to exit the lift and carry away the item. However, present order picker devices tend to have lift mechanisms that may include lift cylinders and/or chains, with both being located such that they are exposed. Lift cylinders and/or chains located on outside areas present a potential risk of injury for operators that may come into contact with such components during operation of the lift. Also, the lift cylinders and/or chains would be subject to damage by contact with other objects. Alternative designs tend to place a lift cylinder in the center of the device, to avoid such risks of injury and damage. This too has drawbacks, as the operator platform space may be compromised and/or the height of the operator platform in its lowered position may be higher than would be desirable for imply stepping onto a platform.

This disclosure sets forth an example electric personnel lift device and methods of using the same that overcome shortcomings in the prior art.

SUMMARY

Disclosed herein is an advantageous example electric personnel lift device that conceals the operative lift components to shield the components from damage and to prevent injury to the operator. The example device provides larger holding or storage space, a low initial operator platform height, and avoids encroaching on the operator's space.

The example electric personnel lift device may be used in various environments when a user is unable to grasp something that is placed above the user's reach. As noted, the device may be particularly well suited for use as a stock picker for use in retail, warehousing or industrial settings where objects must be removed from vertically spaced shelving.

In a first aspect, the disclosure provides an advantageous device including an example electric personnel lift device. The electric personnel lift device includes a base assembly having a frame and two columns that are laterally spaced apart and connected to the frame. Each of the two columns has a lift cylinder device located in the respective column and extending upward. The electric personnel lift device further includes a height adjustable platform assembly having an operator platform and two laterally spaced apart handrail assemblies connected to the operator platform. The height adjustable platform assembly is connected to an upper end of a movable portion of each lift cylinder device and is slidably coupled to the columns, wherein the height adjustable platform assembly is movable between at least a lowered position and a raised position.

The example electric personnel lift device utilizes an electric motor that drives a hydraulic system for smooth and powerful lifting. The electric motor is powered by a battery, which may be rechargeable. The example shown also conveniently includes a battery charger, which a retractable cord assembly to permit on-board battery charging.

The example electric personnel lift device includes wheel assemblies that make it portable and easy to manually roll from one location to another. The device may include a parking or braking feature that causes the base assembly to rest on at least one foot when an operator steps onto the operator platform, so as to stop the device from rolling and to remain in place while the lift is being operated. Thus, the base assembly essentially may provide a self-parking configuration by which at least one foot of the base assembly moves from a raised position to a grounded position when the operator platform is forced downward by an operator stepping onto the operator platform. This provides an intuitive and easy to use feature that enhances the safety of the operator.

Thus, the present disclosure presents an alternative to prior art devices that extend the reach of an individual, and the example disclosed provides advantageous features in a more conveniently and efficiently utilized electric personnel lift device. It is to be understood that both the foregoing general description and the following detailed description are exemplary and provided for purposes of explanation only, and are not restrictive with respect to the claimed subject matter. Further features and advantages will become more fully apparent in the following description of the example preferred embodiment and from the appended claims.

BRIEF DESCRIPTION OF THE DRAWINGS

In describing the preferred example, reference is made to the accompanying drawing figures wherein like parts have like reference numerals, and wherein.

Figure 1:
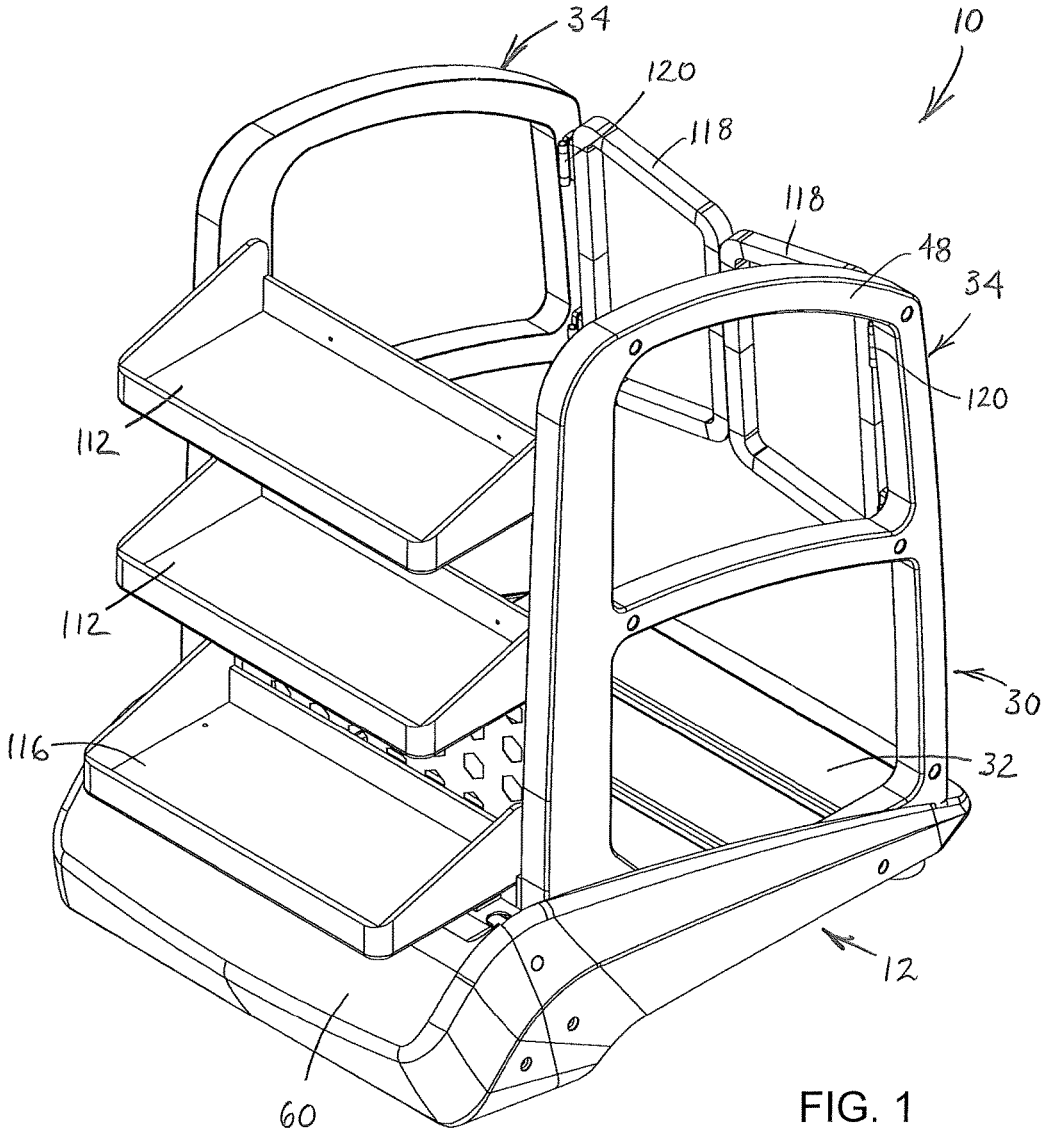
FIG. 1 is a left front perspective view of an example electric personnel lift device having a height adjustable platform in a lowered position.

It should be understood that the drawings are not necessarily to scale. While some mechanical details of personnel lift devices, including some details of fastening or connecting means and other plan and section views of the particular components, have been omitted, such details are considered within the comprehension of those skilled in the art in light of the present disclosure. It also should be understood that the present disclosure is not limited to the examples illustrated.

DETAILED DESCRIPTION OF THE PREFERRED EMBODIMENT

This disclosure presents an example electric personnel lift device and methods of using the same, which may be embodied in several forms. For instance, FIGS. 1-12 illustrate an example electric personnel lift device 10, as will be described further herein with reference to the accompanying drawings of the preferred embodiment. It will be appreciated, however, that the invention may be constructed and configured in various ways and is not limited to the example preferred embodiment shown and described herein.

The example electric personnel lift device 10 includes a base assembly 12 having a frame 14 and two columns 16 that are laterally spaced apart and connected to the frame 14. Each column 16 is hollow and may be connected to the frame 14, for example, by being fixedly connected to a bracket 18, such as by welding, as may be seen in FIGS. 5, 6 and 8. The bracket 18 may, in turn, be connected to the frame 14, such as by being removably connected to the frame 14 by fasteners 20, which may include bolts or other suitable means of fastening, as may be seen in FIG. 8. It will be appreciated that there may be other suitable ways of connecting the columns to the frame.

Figure 5:
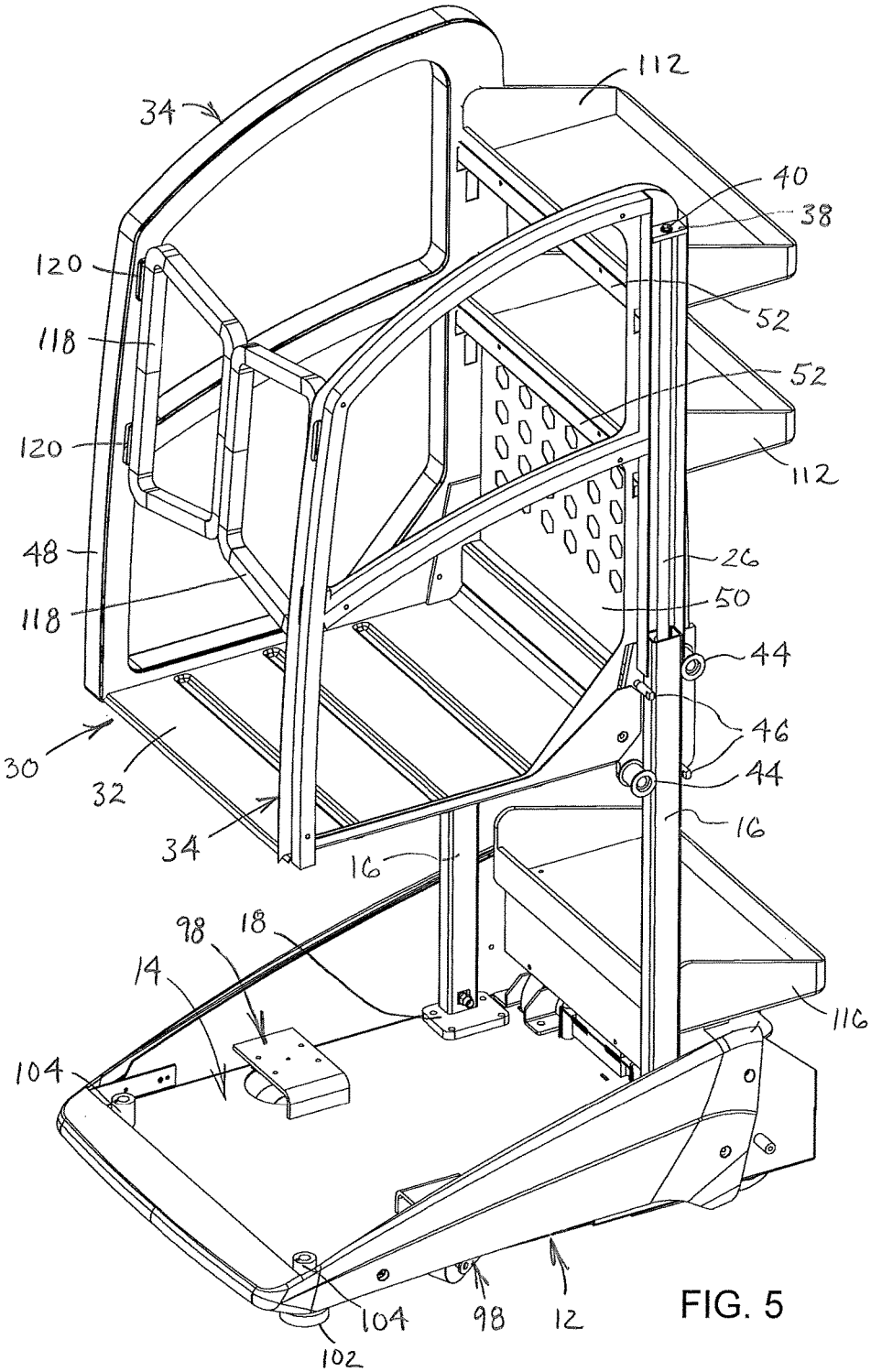
FIG. 5 is a right rear perspective view of the device of FIG. 1, in the raised position shown in FIG. 4, but with the right handrail assembly cover removed.
Figure 6:
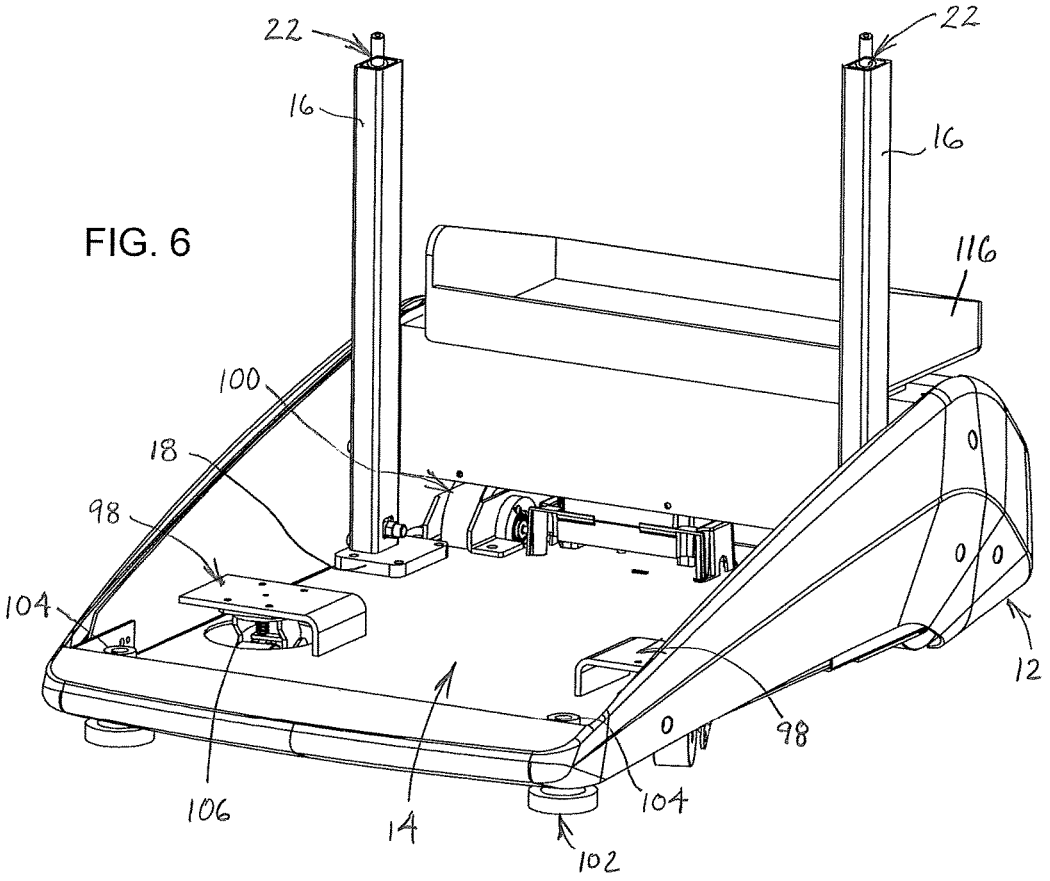
FIG. 6 is a right rear perspective view of the base assembly but with a panel removed to expose the frame, the mounting of the columns and of the wheel assemblies.
Figure 6:
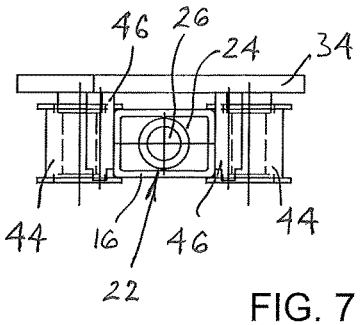
Figure 7:
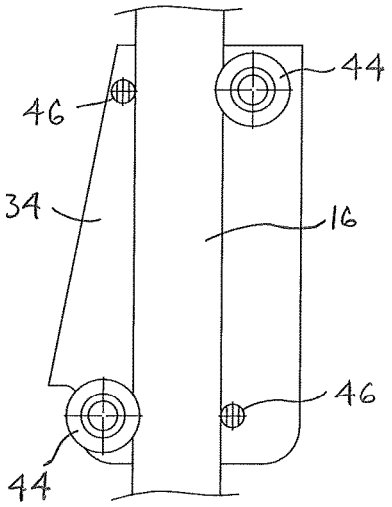
FIG. 7 includes a side plan view and a top view of the slidable coupling of the height adjustable platform assembly to the columns.
Figure 8:
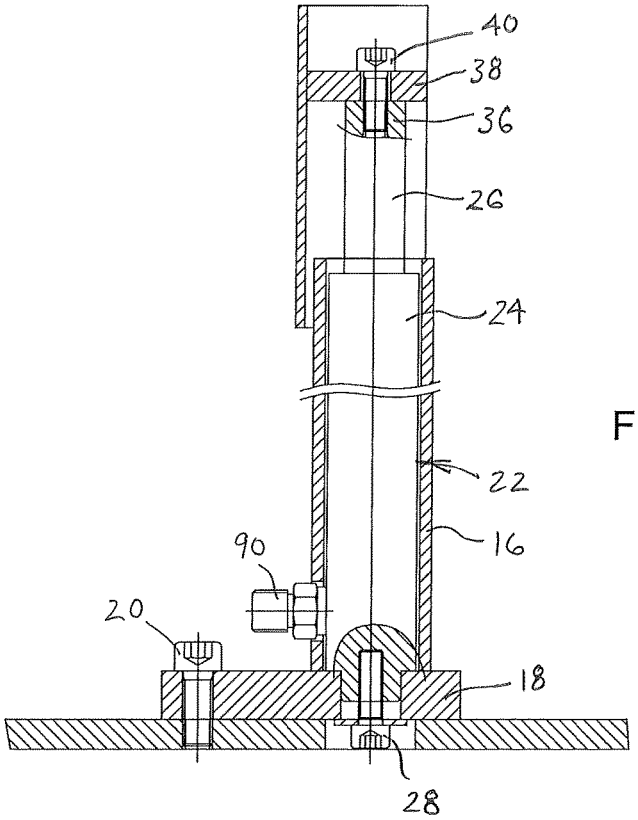
FIG. 8 is a front cross section view of the connection of the lift cylinder device and column to the base assembly of the device of FIG. 1.

Each of the two columns 16 has a lift cylinder device 22 located in the respective column 16 and extending upward, as may be seen in FIGS. 5 and 8. Each lift cylinder device 22 includes a lower cylinder 24 and a movable piston rod 26 that is further extendible upward. In this example, each lift cylinder is removably connected to the bracket 18 by a fastener 28, although it will be appreciated that other suitable means of connection to the bracket 18, column 16 and ultimately the frame 14 of the base assembly 12 may be utilized.

A height adjustable platform assembly 30 has an operator platform 32 and two laterally spaced apart handrail assemblies 34 connected to the operator platform 32. As may be seen in FIGS. 5 and 8, the height adjustable platform assembly 30 is connected to an upper end 36 of a movable portion of each lift cylinder device 22 and is slidably coupled to the columns 16. For example, the upper end 36 of the piston rod 26 of the lift cylinder device 22 may be connected to a flange 38 in an upper portion of a handrail assembly 34, such as by a fastener 40, which may include a bolt or other suitable means of fastening.

Figure 2:
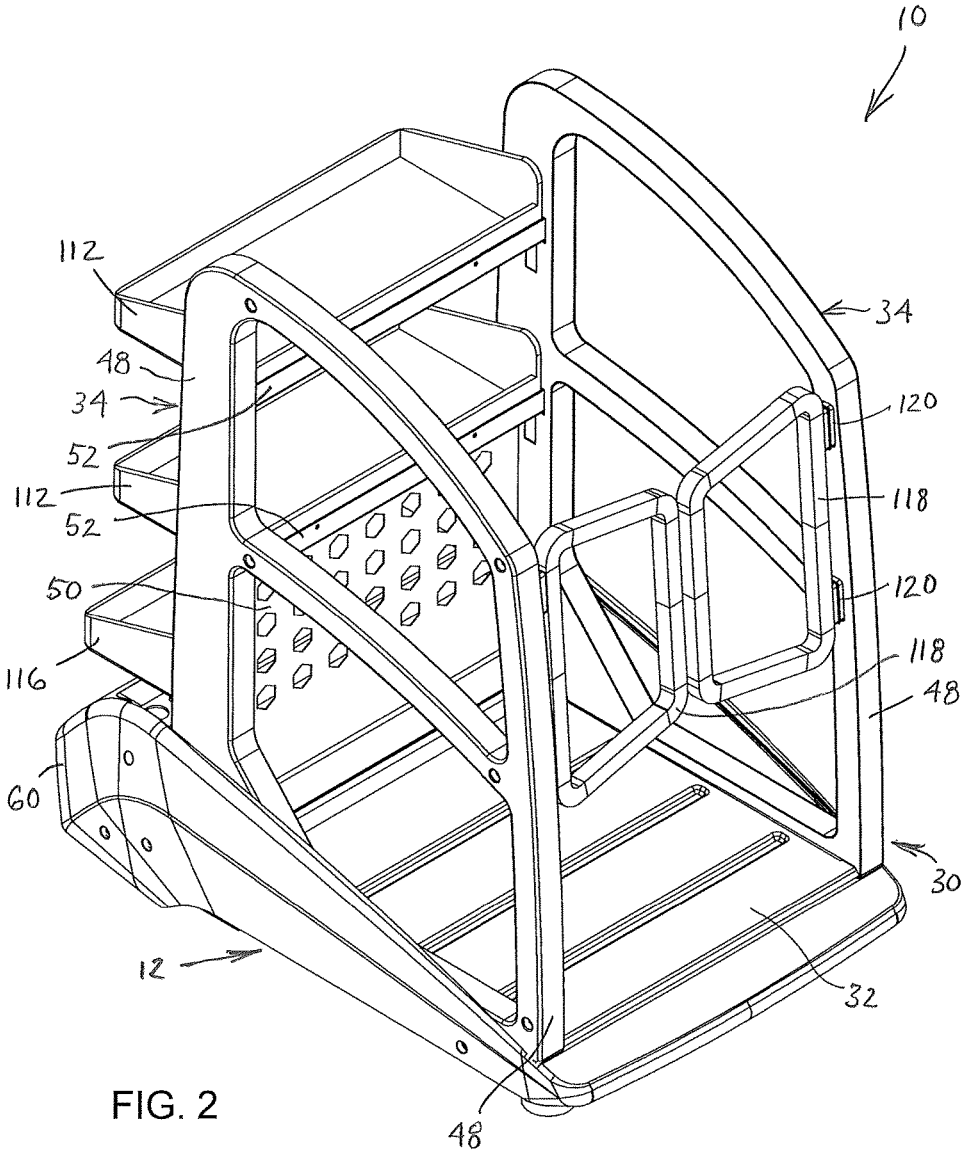
FIG. 2 is a left rear perspective view of the device of FIG. 1.
Figure 3:
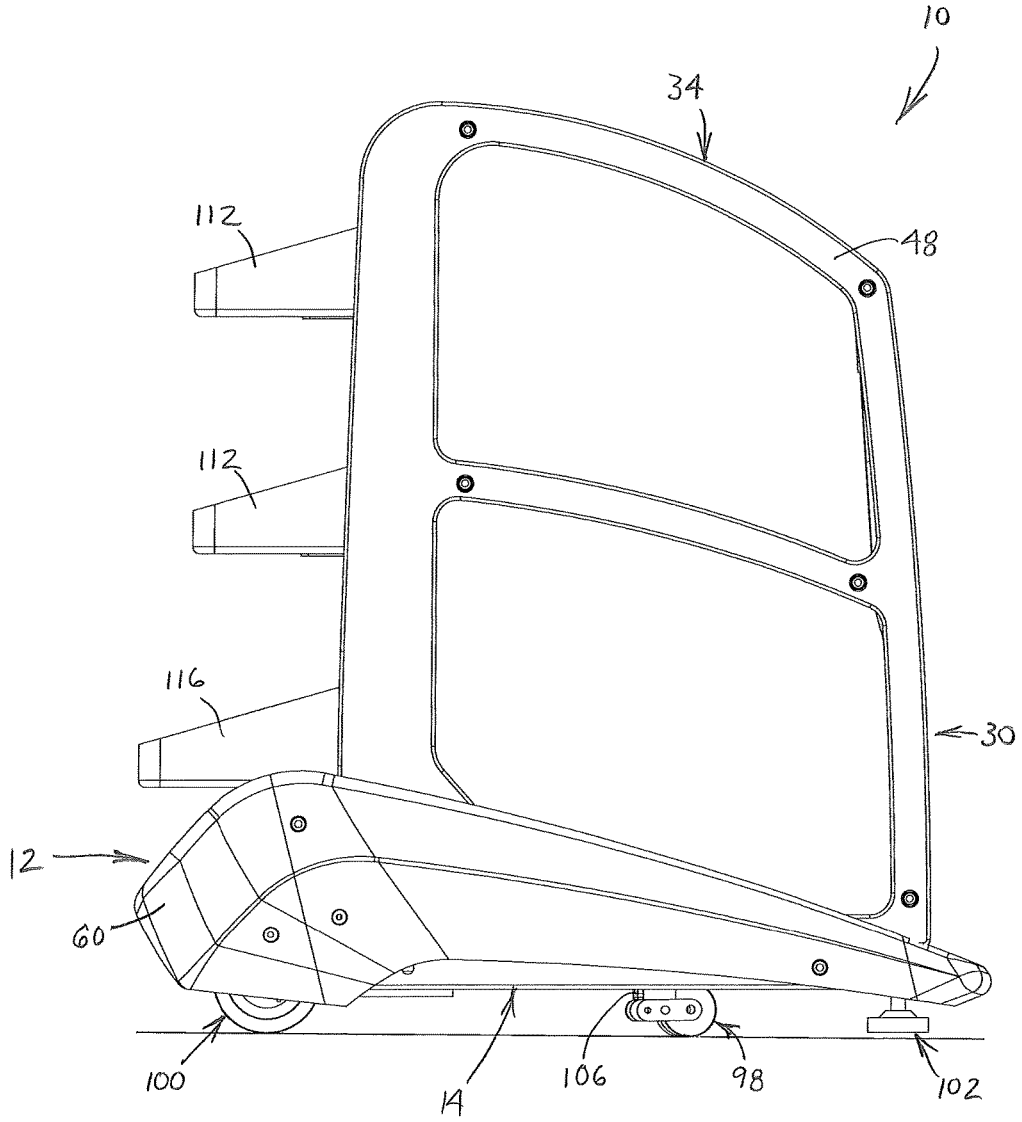
FIG. 3 is a left side plan view of the device of FIG. 1, shown on a floor surface.
Figure 4:
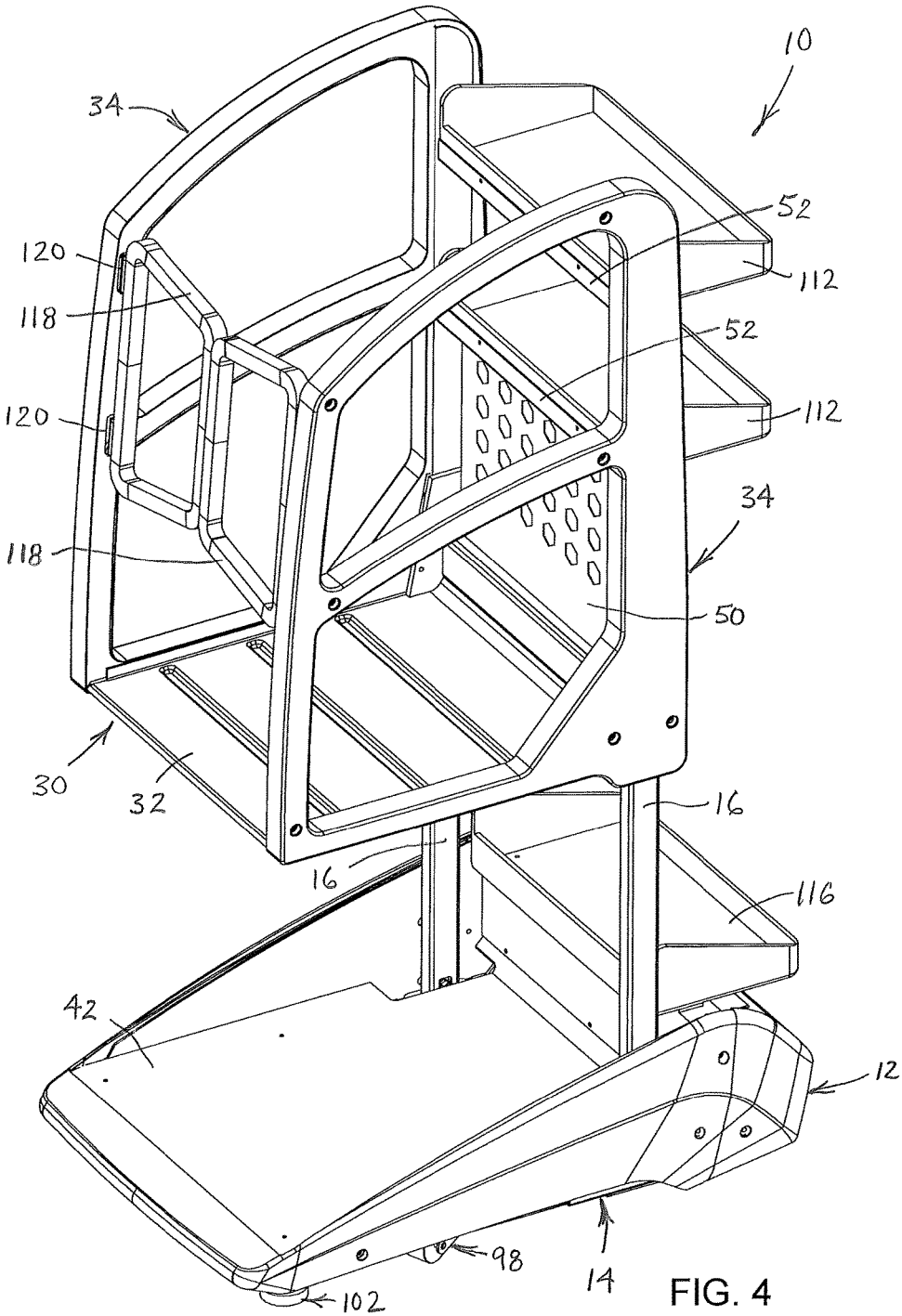
FIG. 4 is a right rear perspective view of the example electric personnel lift device of FIG. 1 having the height adjustable platform in a raised position above the base assembly.

The height adjustable platform assembly 30 is movable between at least a lowered position, seen in FIGS. 1-3, and a raised position, seen in FIG. 4. Moreover, when the height adjustable platform assembly 30 is in the lowered position, the operator platform 32 is adjacent the frame 14, which is concealed and protected by a panel 42 of the base assembly 12.

The height adjustable platform assembly 30 that is slidably coupled to the columns 16 further includes a set of at least two rollers 44 for each respective column 16 and the two rollers 44 engage opposite sides of the respective column 16. Each roller 44 has a curved surface that tends to keep it centered on the respective column 16. In addition, the rollers 44 that engage the columns 16 are located opposite posts 46 that are connected to the height adjustable platform assembly 30, with the columns 16 located between the rollers 44 and the posts 46. The handrail assemblies 34 conceal moving parts of the two lift cylinder devices 22, by use of an outer cover 48, as may be seen when comparing FIG. 4 to FIG. 5.

The height adjustable platform assembly 30 includes a front cross member 50 that is fixedly connected to the two laterally spaced apart handrail assemblies 34. In this example, the front cross member 50 is in the form of a plate, which may be welded to the handrail assemblies 34. In addition, this example includes further cross members 52 that are located at higher positions along the handrail assemblies 34 and which provide increased stiffness to the height adjustable platform assembly 30.

Figure 9:
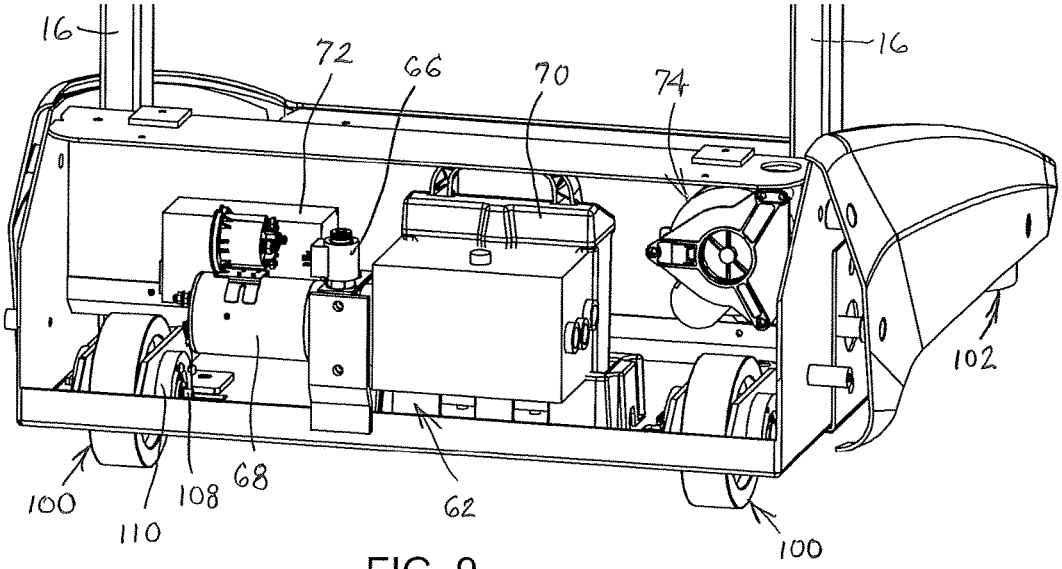
FIG. 9 is a front perspective view of a portion of the base assembly of the device of FIG. 4, but with a front cover removed.

The base assembly 12 of the electric personnel lift device 10 is shown in FIG. 9 with a front cover 60 removed to expose internal components that are otherwise protected, and with the wiring and fluid conduits removed for ease of viewing. For instance, in FIG. 9 one may see a hydraulic system 62 is mounted within the base assembly 12. The hydraulic system includes a fluid reservoir 64, a hydraulic pump, which is concealed within the reservoir 64, an electric hydraulic valve 66. The hydraulic system 62 further includes an electric motor 68 to drive the hydraulic pump. A power source 70 is provided for the electric motor 68. In this example, the power source 70 includes a rechargeable battery. The base assembly 12 also houses a battery charger 72, with a reel device 74, which provides a retractable cord (not shown) for convenient on-board charging of the rechargeable battery 70. These features provide further convenience to the user and avoid having to remove a battery for charging.

Figure 10:
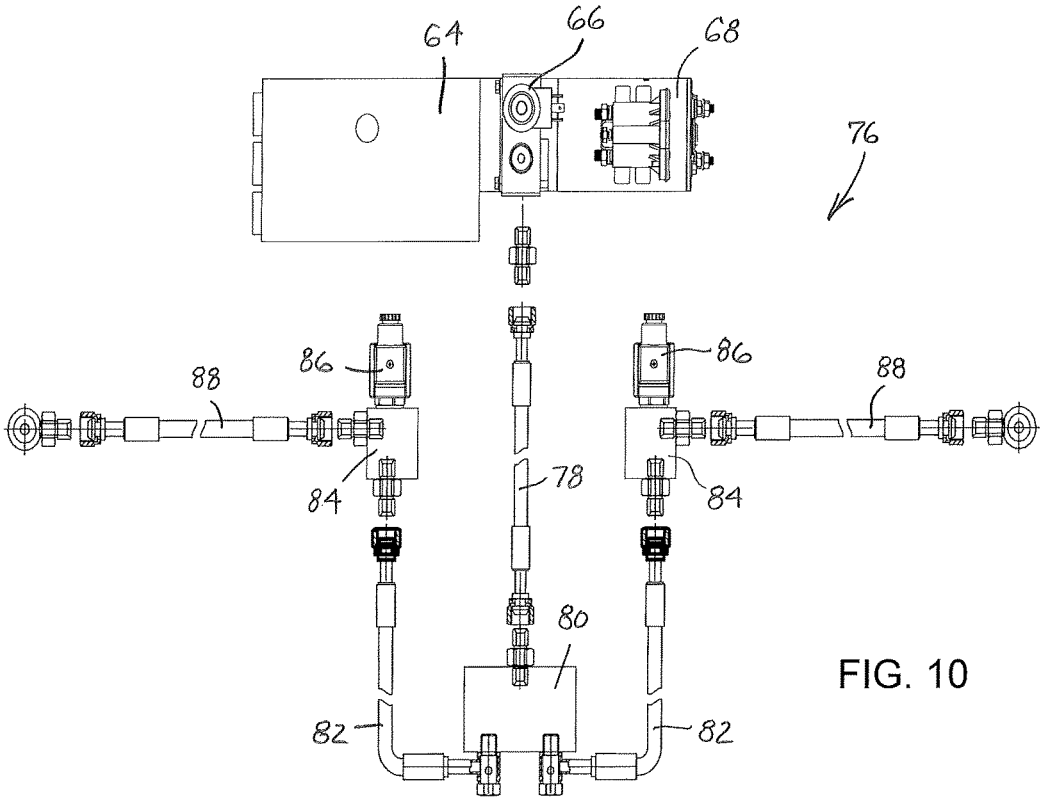
FIG. 10 is a schematic view of the fluid circuit for the hydraulic system of the device of FIG. 1.
Figure 11:
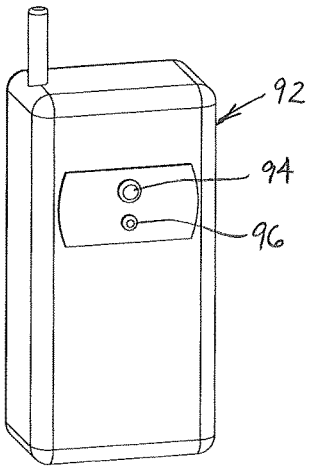
FIG. 11 is a perspective view of a remote control for use with the device of FIG. 1.

The hydraulic system 62 further includes a fluid circuit 76, a schematic view of which is shown in FIG. 10, for fluid connection of the pump and reservoir 64 to the lift cylinder devices 22. The fluid circuit 76 includes a main conduit 78 that extends from the reservoir 64 and valve 66 to a splitter body 80. The splitter body 80 divides the fluid flow into two branch conduits 82, which lead to control blocks 84 having further electric hydraulic valves 86. Connecting conduits 88 extend from the control blocks 84 to ports 90 at the bottom of the columns 16 for connection to the lower cylinders 24 of the lift cylinder devices 22, as may be appreciated when viewing FIGS. 8 and 10. It will be appreciated that the connections within the fluid circuit 76 and hydraulic system 62 may be by convention means for simple upward and downward movement of the lift cylinder devices 22. Furthermore, an operator may operate the electric personnel lift device 10 by use of a handheld control device 92, in the form of a transmitter having simple buttons 94, 96 to send a signal to provide upward and downward movement of the height adjustable platform assembly 30. It will further be appreciated that a control device may be mounted on the electric personnel lift device 10, such as on an upper portion of one of the handrail assemblies 34, if desired.

The base assembly 12 of the electric personnel lift device 10 includes a plurality of wheel assemblies 98, 100, which extend downward to contact a ground surface. In addition, the base assembly includes at least one foot 102, which is capable of providing static support. In the example shown, the at least one foot 102 includes two feet 102 located along a lower surface 104 of the base assembly 12 proximate a rear portion of the base assembly 12. As may be appreciated by viewing FIGS. 5 and 12, while the feet 102 could be in the form of a fixed post, bar or other structure, the feet 102 of the present example are adjustable, such as by being threadably engaged with threaded receivers 104 that are fixedly connected to the frame 14, such as by welding.

Figure 12:
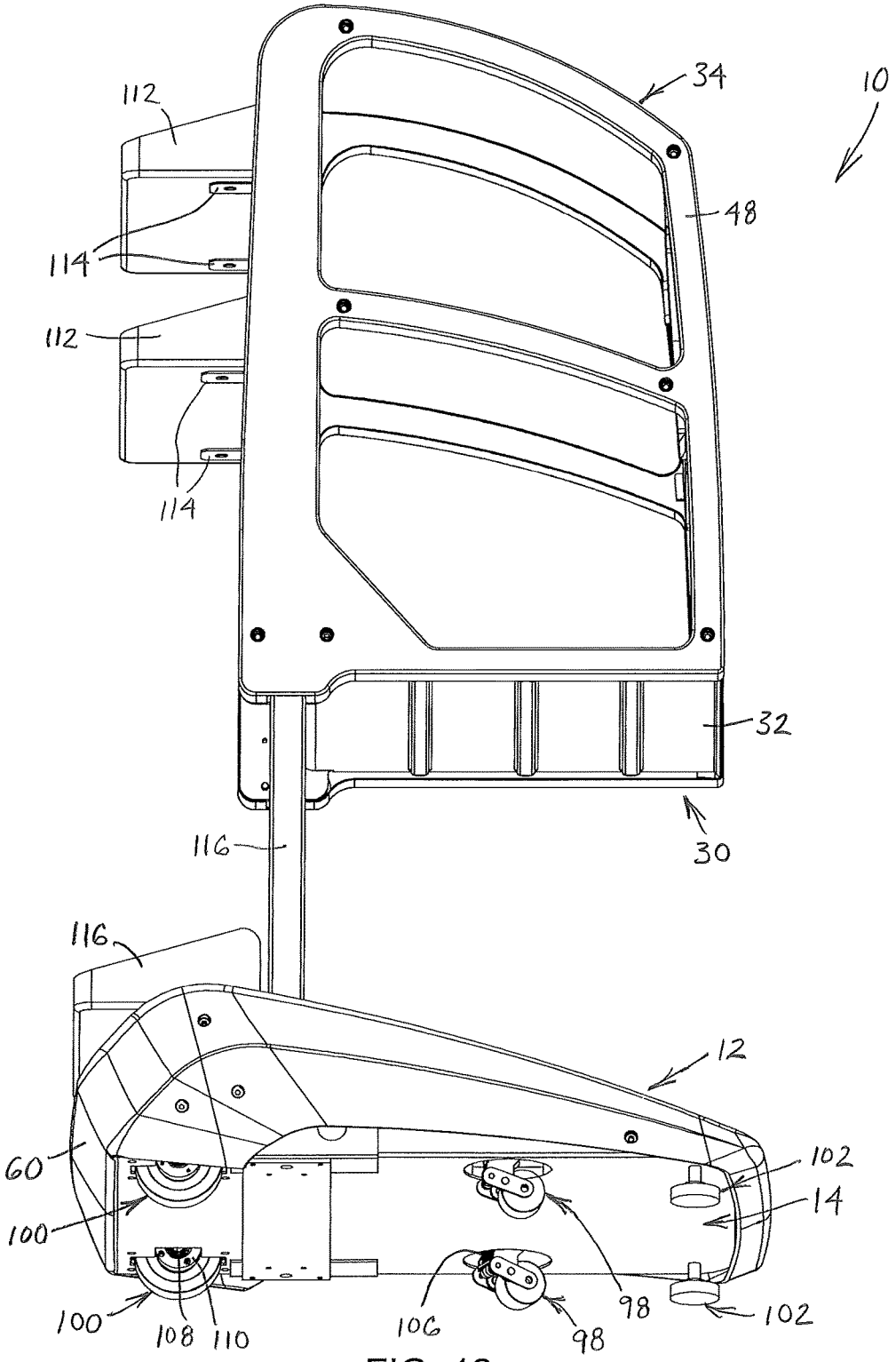
FIG. 12 is a lower left perspective view of the base assembly of the device of FIG. 4, showing the wheel and leg assemblies.

As may best be appreciated from FIGS. 3 and 12, the plurality of wheel assemblies 98, 100 extending downward from the base assembly 14 include at least one wheel assembly 98 that biases the base assembly 14 to a first position wherein the at least one foot 102 is in a raised position, and wherein the base assembly 14 is movable from the first position to a second position wherein the at least one foot 102 is lowered to a grounded position. The example shown includes two wheel assemblies 98 are located near a central portion of the base assembly 12 and each includes at least one spring 106 that assists in biasing the base assembly 14 upward, such that the feet 102 are above the ground surface when the electric personnel lift device 10 is at rest and not engaged by an operator or any other load. When an operator steps onto the operator platform 32, the force overcomes the biasing by the wheel assemblies 98 and the feet 102 at near the rear portion of the base assembly 12 move downward to engage the ground. In this sense, the base assembly 12 provides for automatic parking or braking when an operator simply steps onto the operator platform 32.

In the example shown, the plurality of wheel assemblies further includes at least two wheel assemblies 100 that rotate about a fixed axis of rotation because they simply include axles 108 having bearing supports 110 that do not move. The two wheel assemblies 100 that rotate about a fixed axis of rotation are located proximate a front portion of the base assembly 12.

For convenience in holding objects when lifting them up to be shelved or when retrieving them during order picking, the height adjustable platform assembly 30 of the electric personnel lift device 10 includes at least one shelf 112. As may be appreciated by FIGS. 4 and 12, the example shown includes two shelves 112 supported by mounting tabs 114 of the upper cross members 52 that are connected to the handrail assemblies 34. For additional capacity, as seen in FIGS. 1 and 4, the base assembly 12 may further include at least one shelf 116. Given the hidden and strategically placed lift structures, the electric personnel lift device 10 provides a large, unobstructed operator platform 32, as well as ample, conveniently located shelving and storage areas 112, 116.

Additional safety is provided by having gates 118 pivotally connected to the handrail assemblies 34 at the rear of the height adjustable platform assembly 30. The gates are connected to spring biased hinges 120, which permit pivoting forward, but move back to the original position when released, and do not permit pivoting rearward. Thus, an operator may conveniently press the gates 118 forward while stepping onto the operator platform 32, and once released, the gates 118 will close, blocking exit from the height adjustable platform assembly 30. To exit, the operator must pull the gates 118 forward and swing them outward toward the handrail assemblies 34, and then walk between the gates 118 to step off of the operator platform 32. This gate structure provides convenient, intuitive use of the safety gates 118.

It will be appreciated that the disclosed examples present numerous potential combinations of elements for carts and pallets and methods of their use. Thus, while the present disclosure shows and demonstrates various example carts that may be adapted for use in transporting pallets, these examples are merely illustrative and are not to be considered limiting. It will be apparent to those of ordinary skill in the art that various carts and pallets may be constructed and configured for use in moving goods, without departing from the scope or spirit of the present disclosure. Thus, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

The invention claimed is:

1. An electric personnel lift device, comprising:

a base assembly having a frame and two columns that are laterally spaced apart and connected to the frame;

each of the two columns having a lift cylinder device located in the respective column and extending upward;

a height adjustable platform assembly having an operator platform and two laterally spaced apart handrail assemblies connected to the operator platform;

the height adjustable platform assembly is directly connected to an upper end of a movable portion of each lift cylinder device and is slidably coupled to the columns;

wherein the height adjustable platform assembly is movable between at least a lowered position and a raised position;

wherein the two laterally spaced apart hand rail assemblies conceal the two respective laterally spaced apart columns when the height adjustable platform assembly is in the lowered position and conceal moving parts of the two lift cylinder devices and coupling assemblies between the height adjustable platform assembly and the columns;

wherein the operator platform extends rearward relative to the two laterally spaced columns;

a hydraulic system further comprising a fluid reservoir, a hydraulic pump, an electric motor that drives the hydraulic pump and a power source connected to the electric motor; and wherein the a hydraulic system is in fluid communication with the respective lift cylinder devices and is located within the base assembly, forward of the two laterally spaced columns and the height adjustable platform assembly, wherein the coupling assemblies of the height adjustable platform assembly that is slidably coupled to the columns include a set of at least two rollers for each respective column and the two rollers engage opposite sides of the respective column, wherein the coupling assemblies that include the rollers that engage the columns also include posts that are located opposite the rollers, wherein the posts are connected to the height adjustable platform assembly, with the columns located between the rollers and the posts.

2. The electric personnel lift device of claim 1, wherein when the height adjustable platform assembly is in the lowered position, the operator platform is adjacent the frame of the base assembly.

3. The electric personnel lift device of claim 1, wherein each handrail assembly further comprises an outer cover.

4. The electric personnel lift device of claim 1, wherein the height adjustable platform assembly further comprises a front cross member that is fixedly connected to the two laterally spaced apart handrail assemblies.

5. The electric personnel lift device of claim 1, wherein each column is connected to a bracket that is connected to the frame of the base assembly.

6. The electric personnel lift device of claim 5, wherein each lift cylinder device is removably connected to the bracket.

7. The electric personnel lift device of claim 5, wherein each column is fixedly connected to the bracket and each bracket is removably connected to the frame.

8. The electric personnel lift device of claim 1, wherein the power source further comprises a rechargeable battery.

9. The electric personnel lift device of claim 8, further comprising a battery charger.

10. The electric personnel lift device of claim 1, wherein the base assembly further comprises a plurality of wheel assemblies extending downward.

11. The electric personnel lift device of claim 1, wherein the base assembly further comprises at least one foot.

12. The electric personnel lift device of claim 11, wherein the at least one foot further comprises two feet located along a lower surface of the base assembly proximate a rear portion of the base assembly.

13. The electric personnel lift device of claim 11, wherein the base assembly further comprises a plurality of wheel assemblies extending downward and at least one wheel assembly located below the height adjustable platform assembly and that biases the base assembly to a first position wherein the at least one foot is in a raised position and wherein the base assembly is movable from the first position to a second position wherein the at least one foot is lowered to a grounded position.

14. The electric personnel lift device of claim 13, wherein the at least one wheel assembly that biases the base assembly to the first position further comprises at least one spring.

15. The electric personnel lift device of claim 13, wherein the at least one wheel assembly that biases the base assembly to the first position swivels and is located proximate a central portion of the base assembly.

16. The electric personnel lift device of claim 13, wherein the at least one wheel assembly that biases the base assembly to the first position further comprises two wheel assemblies that bias the base to the first position.

17. The electric personnel lift device of claim 10, wherein the plurality of wheel assemblies further comprise at least two wheel assemblies that rotate about a fixed axis of rotation and are located forward of the adjustable height platform assembly.

18. The electric personnel lift device of claim 1, wherein the height adjustable platform assembly further comprises at least one shelf.

19. The electric personnel lift device of claim 1, wherein the base assembly further comprises at least one shelf.

* * * * *